US009295616B2

(12) United States Patent
Kellogg

(10) Patent No.: US 9,295,616 B2
(45) Date of Patent: Mar. 29, 2016

(54) TEETHER

(71) Applicant: Mello & Company, LLC, Traverse City, MI (US)

(72) Inventor: Chrysoula Kellogg, Traverse City, MI (US)

(73) Assignee: Mello & Company, LLC, Traverse City, MI (US)

( * ) Notice: Subject to any disclaimer, the term of this patent is extended or adjusted under 35 U.S.C. 154(b) by 336 days.

(21) Appl. No.: 13/773,817

(22) Filed: Feb. 22, 2013

(65) Prior Publication Data

US 2014/0243895 A1 Aug. 28, 2014

(51) Int. Cl.

| | |
|---|---|
| ***A61J 17/02*** | (2006.01) |
| ***A63H 33/00*** | (2006.01) |
| *A61J 17/00* | (2006.01) |

(52) U.S. Cl.

CPC ..... *A61J 17/02* (2013.01); *A63H 33/006* (2013.01); *A61J 17/00* (2013.01); *A61J 17/001* (2015.05)

(58) Field of Classification Search

CPC ..... A61J 17/00; A61J 17/02; A61J 2017/001; A61J 2017/007

USPC ..... 606/234–236

See application file for complete search history.

(56) References Cited

U.S. PATENT DOCUMENTS

| | | | | |
|---|---|---|---|---|
| 5,890,620 | A | 4/1999 | Belcastro | |
| 6,108,869 | A | 8/2000 | Meessmann et al. | |
| D541,355 | S | 4/2007 | Strasbach | |
| 7,562,789 | B2 | 7/2009 | Randolph et al. | |
| 2003/0192891 | A1 | 10/2003 | Ziegler | |
| 2004/0210252 | A1* | 10/2004 | Minoguchi et al. | 606/234 |
| 2005/0080456 | A1* | 4/2005 | Sanbrook et al. | 606/235 |
| 2005/0217159 | A1* | 10/2005 | Leung | 40/725 |
| 2006/0155332 | A1* | 7/2006 | Jewett | 606/234 |
| 2009/0130944 | A1* | 5/2009 | Friedman et al. | 446/71 |
| 2009/0287247 | A1* | 11/2009 | Chipperson et al. | 606/235 |
| 2011/0264142 | A1 | 10/2011 | Reed | |

OTHER PUBLICATIONS http://www.ourpieceofearth.com/tommee-tippee-review-chewther/, Our Piece of Earth, Tommee Tippee Review—Chewther, Apr. 4, 2012 as accessed on Jul. 22, 2015.* https://web.archive.org/web/20100501135753/http://www.twin-novationsllc.com/products.htm, TW Innovations, May 1, 2010 as accessed on Jul. 22, 2015.* https://web.archive.org/web/20120603232311/http://www.twin-novationsllc.com/products.htm, TW Innovations, Jun. 3, 2012 as accessed on Jul. 22, 2015.*

Buzzillions, Nuk Sip & Smile 2 Handle Soft Spout Cup—7oz—2pk-P, website advertisement, Feb. 2, 2011 (per reviews), 3 pages, www.buzzillions.com, U.S.

amazon.com, KidGear The Teethifier II, website advertisement, May 11, 2009 (per reviews), 7 pages, www.amazon.com, U.S.

* cited by examiner

*Primary Examiner* — Todd J Scherbel

(74) *Attorney, Agent, or Firm* — Northern Michigan Patent Law, PLC

(57) ABSTRACT

A teether is provided wherein the teether includes a base, a first member, and a second member. The first member may be integrally formed on a first side of the base. The second member may also be integrally formed on a second side, opposite the first side of the base. The first and second members each include a first area which extends in a substantially perpendicular direction from the base. The first and second members also each include a second area which extends in a substantially perpendicular from the first area.

14 Claims, 3 Drawing Sheets

TEETHER

BACKGROUND

The present disclosure relates generally to the field of juvenile products. More specifically, the present disclosure relates to a teether that is easy for a toddler to hold yet can allow the child to access all areas of their gums and teeth to relieve discomfort associated with a teething condition.

During the first few years of life, a child generally makes considerable development in height and weight. The child begins teething, developing sensory discrimination, and usually begins to walk and talk. Tooth development in children occurs through the two bottom teeth in the child's gums. Approximately, four to eight weeks later, the two lower incisors emerge from the gums. Subsequently, the first molars come out next then the canine or the eye teeth develop.

The American Academy of Pediatrics has stated that teething may cause a child some discomfort such as but not limited to, mild irritability, crying, low-grade temperature, excessive drooling, and a strong desire to chew something hard. The gums surrounding the developing or new teeth usually swell and are tender. Parents and caregivers may be encouraged to soothe the teething baby or toddler with a finger. Teething rings are also beneficial in which the teething ring is made from a firm material such as rubber. As known in the art, teething rings are traditionally provided as a polymeric ring-like member. The ring-like member may be formed from a softer polymeric material or the ring-like member may be formed from a rigid polymeric material.

Many experts in early childhood development believe that appropriate tactile stimulation and exposure to different shapes and movements enhances normal development of the senses, motor skills and thinking ability. Accordingly, a wide variety of teething devices are commercially available. Each of these teething devices offer its own combination of texture, sound and movement.

As shown in U.S. Design Pat. No. 54135551 issued to Strasbach, one teething device of the prior art is a giraffe shaped teether 110 which is designed to allow a toddler or baby to soothe their teething discomfort while entertaining a child with its animal-shaped spotted design. However, one critical drawback of the animal-shaped (giraffe) design is that the configuration of this design creates a choking hazard to toddlers as the end portions 112 of this animal-shaped teether may inappropriately extend into the child or toddler's throat resulting in a choking hazard for the child. This is an area of particular concern given that toddlers or babies are still learning how to walk and/or sit up properly, and as a result, may mishandle the teether while it is in use.

Accordingly, a need exists for a teething toy that is more effective than the convention teething toys by providing a baby or a young child effective teething relief to every section of the gum area while also preventing any potential choking hazards.

SUMMARY

A teether is provided which effectively reaches all areas of a child's tender gum area, including but not limited to the child's back molar area and teeth, while preventing any risk of choking to the child. The teether of the present disclosure includes a base, a first member, and a second member. The first member may be integrally formed on a first side of the base. The second member may also be integrally formed on a second side opposite the first side of the base. The first and second members each include a first area which extends in a substantially perpendicular direction from the base. The first and second members also each include a second area which extends in a substantially perpendicular from the first area.

BRIEF DESCRIPTION OF THE DRAWINGS

The present invention will now be described by way of example, with reference to the accompanying drawings.

DETAILED DESCRIPTION

Figure 1:
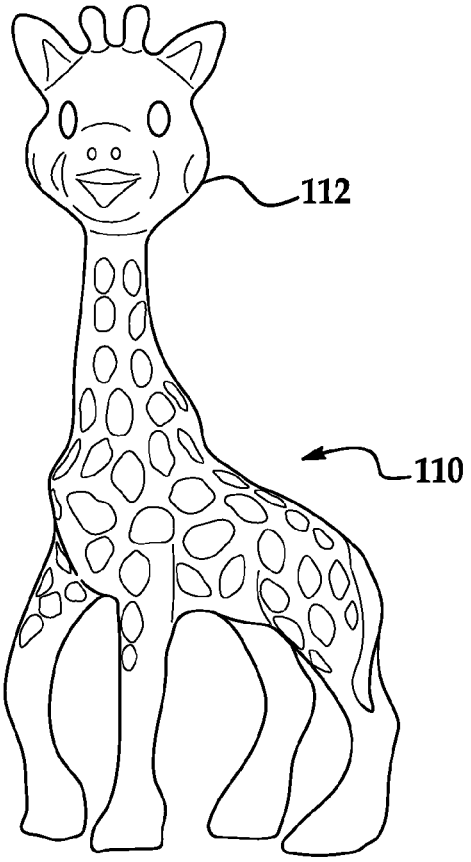
FIG. 1 PRIOR ART
FIG. 1 is a front view of a prior art design.
Figure 2:
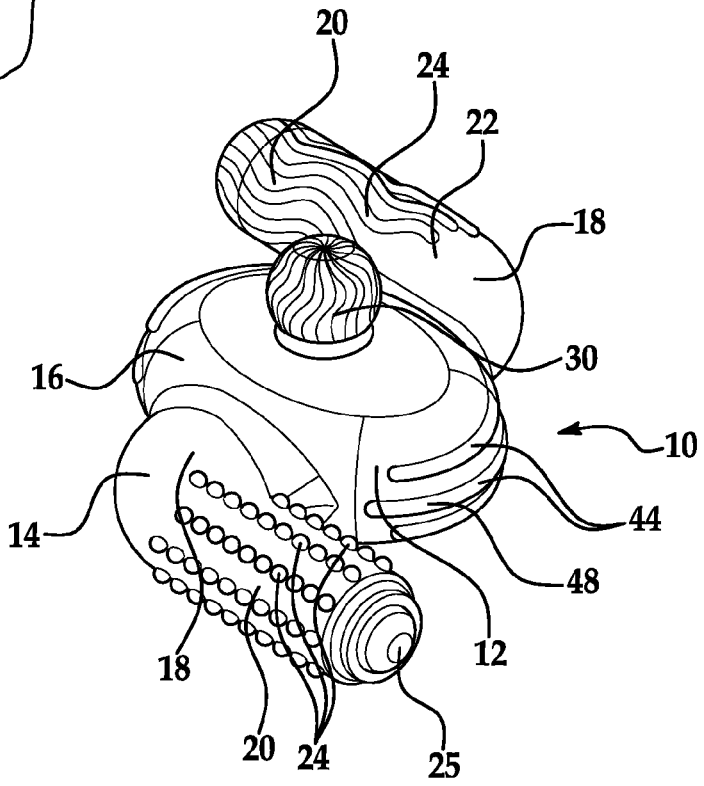
FIG. 2 is an isometric view of a non-limiting example of an embodiment of the present disclosure.

Referring now to the drawings wherein like reference numerals are used to identify identical components in the various views, FIG. 2 illustrates an isometric view of a first embodiment of the present disclosure.

Figure 3:
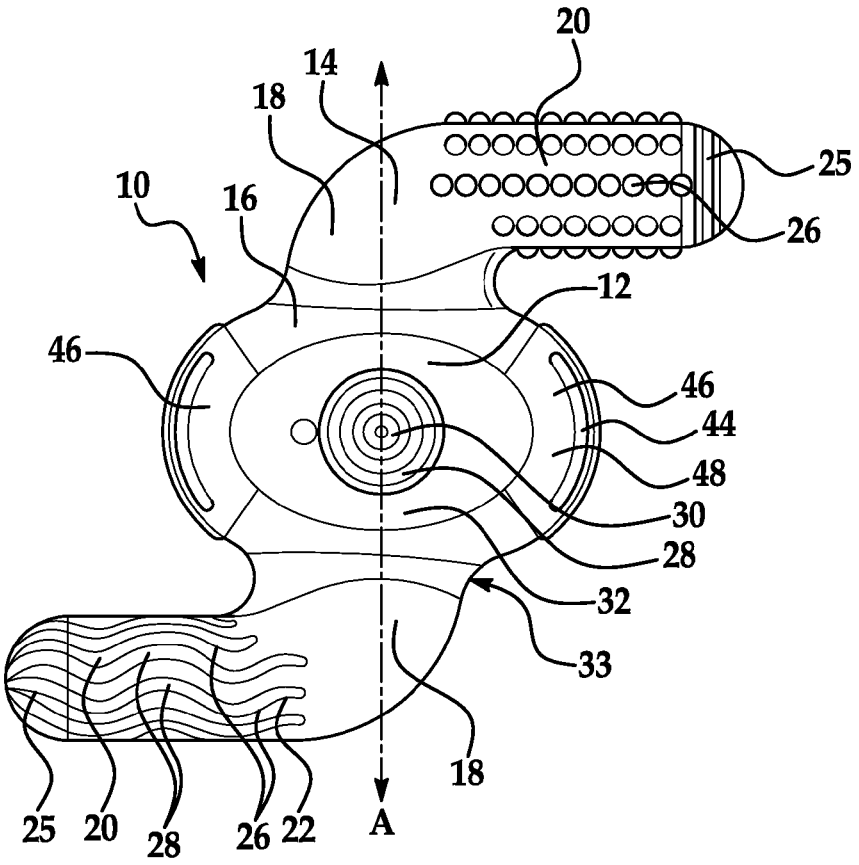
FIG. 3 is a bottom view of a non-limiting example of an embodiment of the present disclosure.

A teether 10 shown in FIG. 2. The teether 10 of FIG. 2 is an isometric view of a non-limiting example of the present disclosure. With reference to FIG. 3, a bottom view of the teether 10 in FIG. 3 is shown. As shown in FIGS. 2 and 3, the teether 10 includes a base 12. The base 12 is preferably oval in shape. It is also appreciated that the base 12 may be colorful to attract the attention of a young child.

As shown, a first member 14 is integral to the base 12 and projects from a first side 16 of the base 12. The first member 14 may have the same modulus of elasticity as the base 12 or it may have a different modulus of elasticity relative to the base 12. The first side 16 of the base 12 may be the elongated side of the oval base 12. The first member 14 has a first area 18 that extends in a substantially perpendicular direction from the base 12. The first member 14 may further include a second area 20 which extends in a substantially perpendicular direction relative to the first area 18.

As shown in FIGS. 2 and 3, the second area 20 may include a plurality of smaller protuberances 26 that extend from the surface of the second area 20. The smaller protuberances 26 may be integrally formed with the second area 20. Furthermore, the smaller protuberances 26 may either have the same modulus of elasticity as the first member 14 or may have a different modulus of elasticity of the first member 14. By varying the elasticity of the plurality of smaller protuberances 26 relative to the first member 14, a young child may be able to obtain appropriate treatment to the young child's tender gums and tooth area by varying the force exerted to the child's gum and tooth area.

As shown in FIGS. 2 and 3, the plurality of smaller protuberances 26 on the first member 14 may be in the form of smaller semi-sphere like extensions 24 that protrude from the first member 14. The smaller semi-sphere-like extensions or semi-sphere like extensions 24 are integrally formed with the first member 14. As shown, the second area 20 of the first member 14 is in close proximity to the base 12 and runs parallel to the base 12. This configuration prevents the risk of the first member 14 from extending too far into a child's throat yet allows enough space between the second area 20 and the base 12 to accommodate the cheek of a child as the child implements the teething device. Furthermore, by allowing the first member 14 to be used as a means to exert force against a child's tender gums, the second area 20 also sufficiently extends to the rear gum area of a child to ease discomfort in the rear molar area.

As shown in FIGS. 2 and 3, a second member 22 may further be formed on the teether 10 of the present disclosure. In this example, the second member is disposed on the side of the base 12 opposite the first member 14.

The second member 22, like the first member 14, has a first area 18 that extends in a substantially perpendicular direction from the base 12. The second member 22 may, like first member 14, further include a second area 20 which extends in a substantially perpendicular direction relative to the first area 18. The second member 22 may also have a surface pattern which is different from the surface pattern of the first member 14.

Rib-like like extensions 28 are integrally on the surface of the second area 20 of the second member 22. Like the first member 14, the second area 20 of the second member 22 is in close proximity to the base 12 and runs parallel to the base 12. This configuration prevents the risk of the second member 22 from extending too far into a child's throat yet allows enough space between the second area 20 and the base 12 to accommodate the cheek (not shown) of a child as the child implements the teething device. Furthermore, by allowing the second member 22 to be used as a means to exert force against a child's tender gums, the second area 20 also sufficiently extends to the rear gum area of a child to ease discomfort in the rear molar area.

Similar to the first member 14, the second member 22 may be integrally formed to the base 12 and may have a modulus of elasticity that is different from the base 12. It is also appreciated that the second member 22 may alternatively be formed from the same material as the base 12, and therefore, may have the same modulus of elasticity as the base 12.

Figure 4:
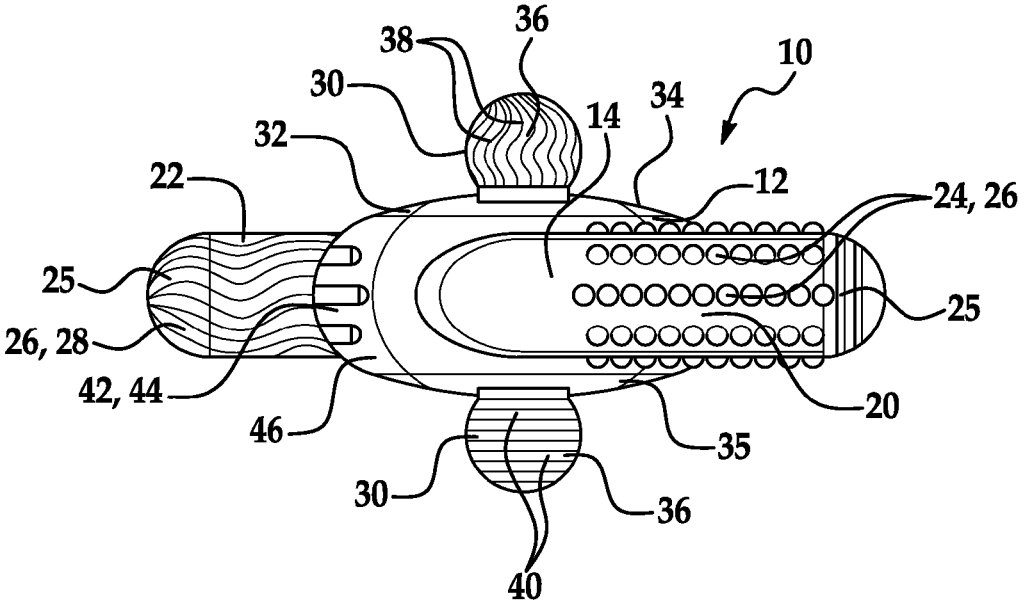
FIG. 4 is a front view of a non-limiting example of an embodiment of the present disclosure.

With reference to FIG. 4, a front view of a non-limiting example of the present disclosure is shown. The base 12 further includes at least one substantially sphere-like extension 30 from a substantially horizontal surface 32 of the base 12. In the non-limiting example of FIG. 4, an upper surface 34 and a lower surface 35 of the base 12 each have a sphere-like extension 30 that is integrally formed with the base 12. Similar to the first member 14, the sphere-like extension 30 may have the same or different modulus of elasticity. The sphere-like extension 30 may be dual injection molded with the base 12 to achieve the different modulus of elasticities for the sphere-like extension 30 and the base 12.

In the event multiple sphere-like extensions 30 are implemented as shown, it is contemplated that each sphere-like extension 30 may have a varying surface 36 to provide appropriate and varying force to the tender gums and teeth of a young child that is teething. As shown in FIG. 4, the first sphere-like extension 30 may include wavy ribs 38 which are substantially perpendicular to the longitudinal axis of the base 12. The second sphere-like extension 30 may include straight ribs 40 which are substantially parallel to the base 12 as shown in the non-limiting example of FIG. 4. It is appreciated that various patterns or no patterns may be implemented on the sphere-like extension 30 that are formed on the base 12. The various patterns shown are simply examples are not intended to be limiting.

Figure 5:
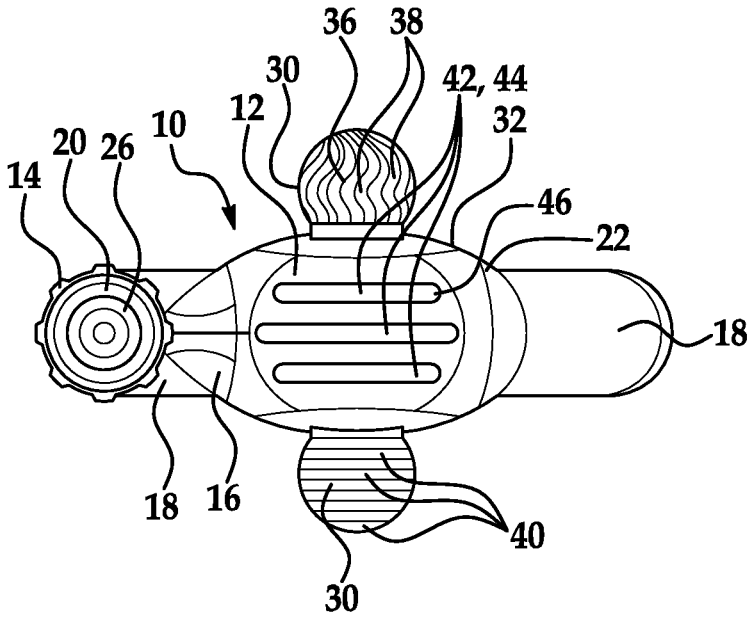
FIG. 5 a side view of a non-limiting example of an embodiment of the present disclosure.

With reference now to FIG. 5, a left side view of a first embodiment of the present disclosure is shown. As shown in FIG. 5, the left side 46 of the base 12 may include an integrally formed surface pattern 42 on the first side 16. The non-limiting example of an integrally formed surface pattern 42 is shown in FIG. 5 where the integrally formed surface pattern 42 is a plurality of fins 44 that extend from the surface of the left side 46 of the base 12. The left side 46 of the base 12 in FIG. 5 has a smaller surface area given that the base 12 in FIG. 5 has an oval shape. The left side 46 of the base 12 is therefore smaller in surface area relative to the sides of the base 12 upon which the first member 14 and second member 22 extend from. The smaller surface area of the base 12 and the oval shape of the base 12 allow a young child to extend this section of the base 12 into his or her mouth without having to over-extend his or her mouth. To the extent that a child is able to place this section of the base 12 closer to the rear end of the molars, the risk of choking is completely eliminated given that the diameter of the base 12 and its associated first and second members 14, 22 are far greater than the opening of a child's mouth.

It is understood that the right side (shown as 48 in FIG. 3) of the base 12 may also have a pattern defined on the surface of the right side of the base 12. The pattern on the right side of the base 12 may be the same (as shown in FIG. 3) or different from the pattern on the left side 46. The varying patterns throughout the teether 10 are provided to provide appropriate and varying force to give a young child the relief needed when he or she has tender gums and new teeth.

It is also understood that the different materials used through out the present disclosure may implement different, child-friendly colors so as to provide visual interest for a young child. The different colors may be part of the polymeric material and uniform throughout the material. Alternatively, some or all of the colors may be implemented as a non-toxic colorant on the teether 10.

Figure 6:
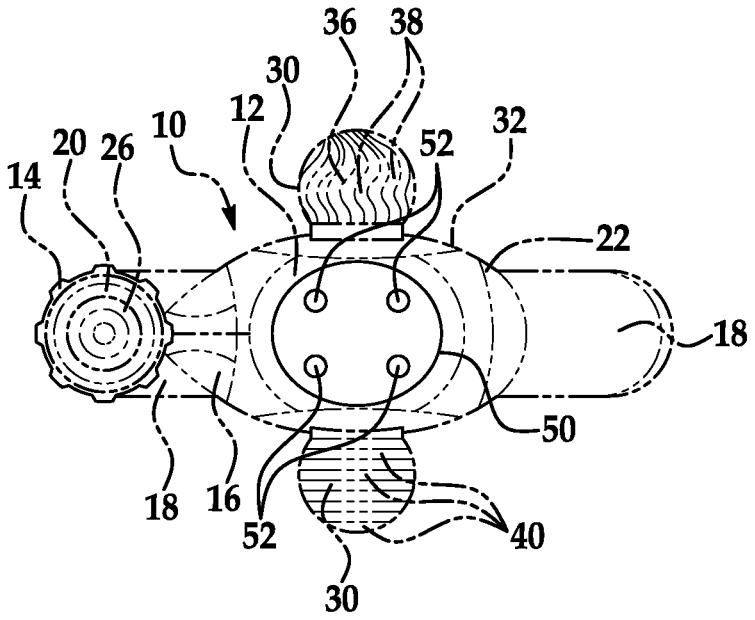
FIG. 6 a cross-sectional view of the teether shown in FIG. 3 along lines A-A.

To further achieve the objective of providing interest to the teething baby or young child and with reference to FIG. 6, the base 12 may include a rigid interior surface 50 which defines a cavity which houses freely moving elements 52 so as to provide a rattling noise when the child shakes the teether 10. Accordingly, the teether 10 of the present disclosure may further provide auditory as well as visual entertainment to a young child or baby as a rattling toy.

While the best mode for carrying out the invention has been described in detail, those familiar with the art to which this invention relates will recognize various alternative designs and embodiments for practicing the invention as defined by the following claims.

What is claimed is:

1. A teether comprising:

a base comprising rounded proximal and distal ends along a longitudinal axis of the base defining a base length between them, first and second sides between the proximal and distal ends and defining a base width between them across a center of the base substantially perpendicular to the base length, and upper and lower surfaces;

a generally L-shaped first teething member integrally formed on the first side of the base, the first teething member comprising a first spacing portion which extends in a first spacing direction from the first side of the base and a first unidirectional extension portion which extends substantially parallel to the first side of the base, the first unidirectional extension portion extending a first extension distance in a first extension direction from the first spacing portion to a first free end, the first free end extending beyond the distal end of the base in a distal direction relative to the longitudinal axis of the base, the first unidirectional extension portion terminating in the first free end, the first spacing portion being substantially perpendicular to the first side of the base, the first unidirectional extension portion being substantially perpendicular to the first spacing portion, the first spacing portion included within the length of the base and spacing the first unidirectional extension portion from the first side of the base a first spacing distance; and, a generally L-shaped second teething member integrally formed on the second side of the base, the second teething member comprising a second spacing portion which extends in a second spacing direction from the second side of the base and a second unidirectional extension portion which extends substantially parallel to the second side of the base, the second unidirectional extension portion extending a second extension distance in a second extension direction generally opposite the first extension direction from the second spacing portion to a second free end, the second free end extending beyond the proximal end of the base in a proximal direction relative to the longitudinal axis of the base, the second unidirectional extension portion terminating in the second free end, the second spacing portion being substantially perpendicular to the second side of the base, the second unidirectional extension portion being substantially perpendicular to the second spacing portion, the second spacing portion included within the length of the base and spacing the second unidirectional extension portion from the second side of the base a second spacing distance.

2. The teether as defined in claim 1 wherein the first and second spacing distances are sufficient to define a cheek space between each of the first and second sides of the base and their respective first and second unidirectional extension portions, the cheek space having a width less than the base width and approximating the width of a child's cheek.

3. The teether as defined in claim 1 wherein the first and second unidirectional extension portions each include protuberances extending from their surfaces in a surface pattern, and further wherein the surface pattern on the first unidirectional extension portion is different from the surface pattern on the second unidirectional extension portion.

4. The teether as defined in claim 1 wherein the first and second unidirectional extension portions are generally parallel to one another.

5. The teether as defined in claim 1 wherein the first and second unidirectional extension portions are generally parallel to their respective first and second sides of the base.

6. The teether as defined in claim 1 wherein the base length is greater than the base width.

7. The teether as defined in claim 6 wherein the upper and lower surfaces of the base are substantially horizontal and define a base height between them.

8. The teether as defined in claim 7 wherein the base includes a sphere-like extension integrally formed on at least one of the upper and lower surfaces.

9. The teether as defined in claim 8 wherein the sphere-like extension further includes a plurality of protuberances which extend from the surface of the sphere-like extension.

10. The teether as defined in claim 1 wherein the base is oval shaped.

11. The teether as defined in claim 10, wherein the base defines an oval having substantially horizontal upper and lower surfaces between the proximal and distal ends, and wherein the first and second teething members are substantially parallel to and extend within a plane between the substantially horizontal upper and lower surfaces.

12. The teether as defined in claim 1 wherein the base further defines a cavity having a rigid interior surface, the base being operatively configured to house freely moving elements within the cavity.

13. The teether as defined in claim 1 wherein the rounded proximal and distal ends of the base further each include an integrally formed surface teething pattern.

14. The teether as defined in claim 1, wherein the first and second sides of the base are generally parallel to one another.

* * * * *